US008800941B2

(12) United States Patent
Kahn

(10) Patent No.: US 8,800,941 B2
(45) Date of Patent: Aug. 12, 2014

(54) UTILITY CLIP

(75) Inventor: Peter Kahn, Brookhaven, NY (US)

(73) Assignee: Unique Tools, Inc., Brookhaven, NY (US)

( * ) Notice: Subject to any disclaimer, the term of this patent is extended or adjusted under 35 U.S.C. 154(b) by 288 days.

(21) Appl. No.: 13/137,827

(22) Filed: Sep. 15, 2011

(65) Prior Publication Data

US 2013/0067698 A1 Mar. 21, 2013

(51) Int. Cl.
*A46B 17/02* (2006.01)

(52) U.S. Cl.
USPC ..... 248/110; 248/229.26; 248/229.16; 248/231.81; 248/229.13; 248/229.23; 248/231.51; 248/309.4; 248/316.1; 248/206.5

(58) Field of Classification Search
USPC ..... 248/110, 229.26, 229.16, 228.7, 230.7, 248/231.81, 205.1, 229.13, 229.23, 230.4, 248/231.51, 309.4, 313, 316.1, 683, 206.5, 248/309.1
See application file for complete search history.

(56) References Cited

U.S. PATENT DOCUMENTS

| | | | | | |
|---|---|---|---|---|---|
| 1,421,478 | A * | 7/1922 | Hope | 15/111 |
| 2,122,868 | A * | 7/1938 | Morgan | 403/290 |
| 2,603,991 | A * | 7/1952 | Oliver | 81/3.55 |
| 3,085,777 | A * | 4/1963 | Lewtan et al. | 248/206.5 |
| 4,175,306 | A * | 11/1979 | Bigelow et al. | 24/507 |
| 4,741,064 | A * | 5/1988 | Riegert et al. | 15/111 |
| 5,419,000 | A * | 5/1995 | Amato et al. | 15/111 |
| 5,979,019 | A * | 11/1999 | Johnson | 24/3.11 |
| 6,014,785 | A * | 1/2000 | Punch et al. | 7/105 |
| 6,754,937 | B1 * | 6/2004 | Martin | 24/351 |
| 6,823,553 | B1 * | 11/2004 | Paredes | 15/105 |
| 7,513,472 | B2 * | 4/2009 | Yang | 248/231.81 |
| 2005/0199771 | A1 * | 9/2005 | Simpson | 248/313 |
| 2006/0278780 | A1 * | 12/2006 | Kovall | 248/213.2 |
| 2008/0083147 | A1 * | 4/2008 | Cucurullo | 40/661.01 |
| 2008/0283701 | A1 * | 11/2008 | Kahn | 248/213.2 |
| 2011/0192950 | A1 * | 8/2011 | Liao | 248/309.1 |

* cited by examiner

*Primary Examiner* — Anita M King
*Assistant Examiner* — Michael McDuffie
(74) *Attorney, Agent, or Firm* — Jonathan E. Grant; Grant Patent Services

(57) ABSTRACT

A utility clip is disclosed wherein the clip can hold a variety of tools and can be used commercially or in the home. The clip comprises a first and second clamping member, with each clamping member having alligator teeth positioned facing each at the inner distal end of the members, with at least one and possibly two useful tools positioned at the proximal end of each of the clamping members.

12 Claims, 5 Drawing Sheets

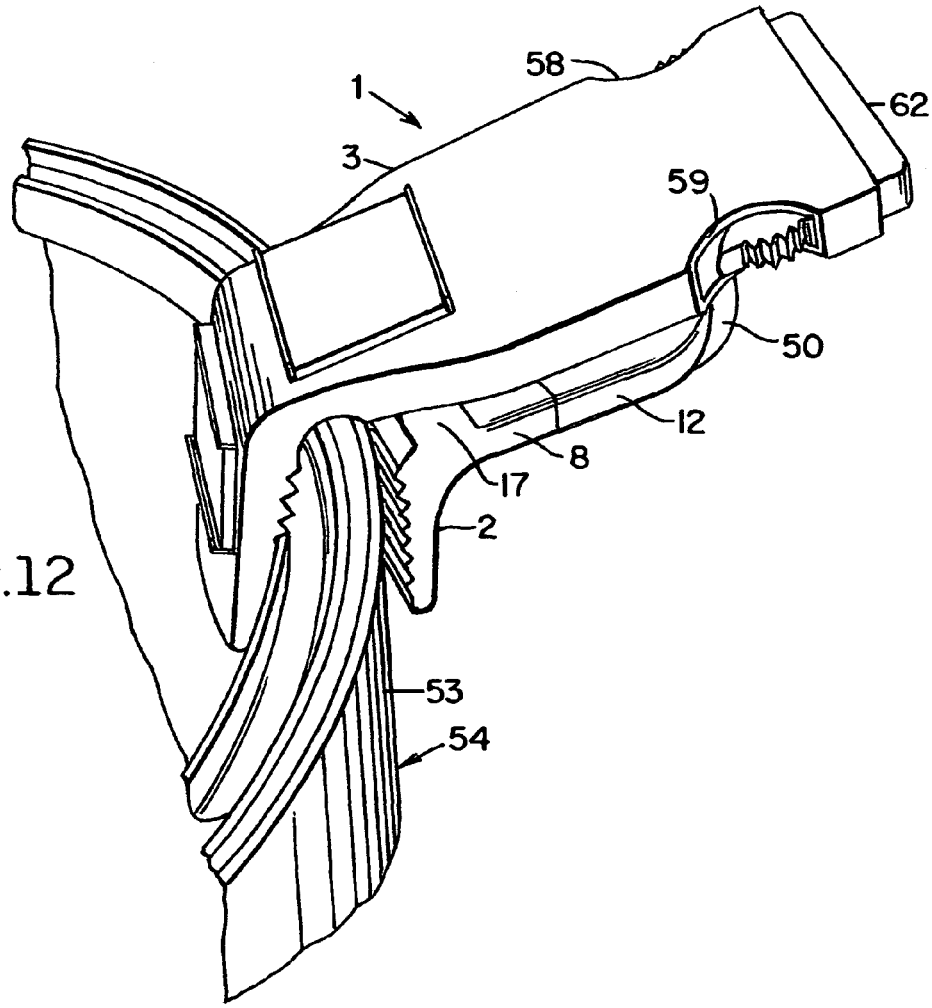
Fig.12
Fig.13a
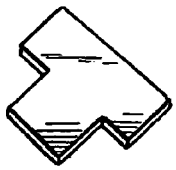
Fig.13b
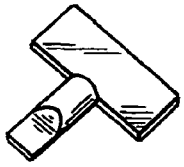
Fig.13c
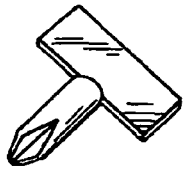

UTILITY CLIP

FIELD OF THE DISCLOSURE

The present disclosure relates to a multifunctional utility clip.

BACKGROUND OF THE DISCLOSURE

Tradesman such as carpenters, drywall experts, window installers, and others use a lot of specialized tools. These tools while useful, are often all cumbersome to have on the job. More specifically, it is difficult to switch from one tool to another.

For example, professional painters generally use a brush and/or a roller to apply paint to desired surfaces. Painters also use and need a variety of equipment within ready reach on the job. Currently, painters waste a lot of time laying out all of their tools, positioning them based on timely need. Painters and other craftman need a device that is can be easily carried or manipulated, and which has a multitude of functions.

U.S. Patent Application No. 2008/0283701 (Kahn) discloses a tool holder device for holding a tool. A tool holder comprises of a clip member, wherein the clip includes a first clamping and a second clamping member, both having jaws and handles. A biased pivot couples the first clamping member and the second clamping member together. The first jaw and the second jaw interconnect. The first jaw and the second jaw may also include ridges. A plurality of coupling members may be permanently disposed about the surfaces of the first and/or the second clamping member. The clip may also include an attachment tool, wherein the tool includes a paint container member and a punctioner member.

U.S. Patent Application No. 20060278780 (incorporated by reference) discloses an apparatus for holding paint brushes on buckets comprising a T-shaped member, hooks, and a clip, said hooks are located upon an upper region of said T-shaped member and are spaced substantially equidistant from each other on opposite sides of said upper region of said T-shaped member, said clip being located upon opposite side of T-shaped member from said hooks.

U.S. Pat. No. 4,757,568 discloses a paint brush having a ferrule telescopically receiving a handle at one end and the bristles at the other is disclosed with supporting and prying means on one side thereof for adapting the brush to hang from the rim of a paint can, in spaced relation from the walls of the can, and to pry off the lid of the can. The supporting and prying device includes a prying portion which projects outwardly of the ferrule and a hook portion located between the prying portion and the end of the ferrule that receives the handle. An adapter member for adapting a conventional paint brush to hang from the rim of a paint can and to adapt the brush to provide a tool for prying open the can is also disclosed as including a base portion, a prying portion and a hook portion. The base portion is mountable to one side of the ferrule whereby the prying portion and the hook portion project outwardly from the base portion and the ferrule. In both the paint brush and the adapter member, the hook portion is spaced apart from the prying portion so that the prying and hook portions are adapted to support the brush within the can with the bristles oriented downwardly. The handle and the ferrule provide a leverage device that cooperates with the prying portion for prying open the can.

BRIEF SUMMARY OF THE DISCLOSURE

The present disclosure teaches a unique multifunctional tool utility clip maximizes the number of tools packaged within one device.

In one embodiment, the device is designed for use by painters, with tools specific for the painting profession.

In another embodiment of the disclosure, the utility clip has at least three tools used in the painting profession. One tool is a lip for removing paint can lids, with a reversible end being a puncture tool, while a third tool is a razor blade, positioned on a clipping member separate from the reversible tool.

In another embodiment, the razor blade is removable from the upper and lower jaws holding the blade in place.

In yet another embodiment, the razor blade can be replaced with a paint scraper.

In another embodiment, the tools included in the utility clip include a straight screwdriver and/or a Phillips head screwdriver.

BRIEF DESCRIPTION OF THE DRAWINGS

In order for the advantages of the invention to be readily understood, a more particular description of the disclosure briefly described above will be rendered by reference to specific embodiments that are illustrated in the appended drawing(s). It is noted that the drawings of the disclosure may not be to scale. The drawings are mere schematics representations, not intended to portray specific parameters of the disclosure. Understanding that these drawing(s) depict only typical embodiments of the disclosure and are not therefore to be considered to be limiting of its scope, the disclosure will be described and explained with additional specificity and detail through the use of the accompanying drawing(s), in which:

FIG. 12 illustrates a perspective of the utility clip attached to the side of a paint can;

FIG. 13*a* illustrates a perspective view of a paint scraper to be inserted into part of the tool;

FIG. 13*b* illustrates a perspective view of a flat screwdriver to be inserted into part of the tool; and FIG. 13*c* illustrates a perspective view of a Phillips head screwdriver to be inserted into part of the tool.

DETAILED DESCRIPTION OF THE DISCLOSURE

Figure 1:
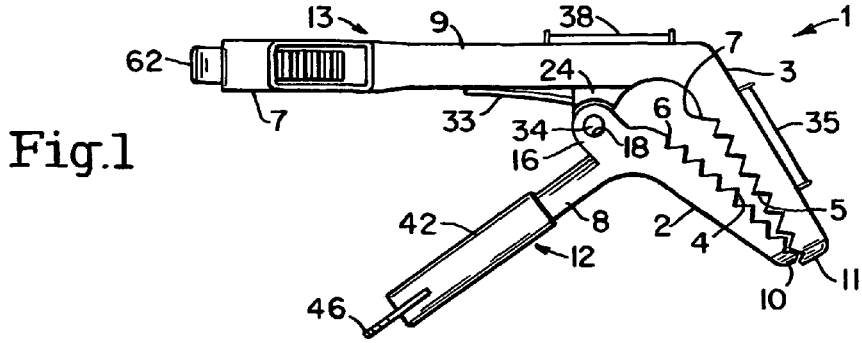
FIG. 1 illustrates is a perspective view of a utility clip, according to one embodiment of the disclosure.
Figure 2:
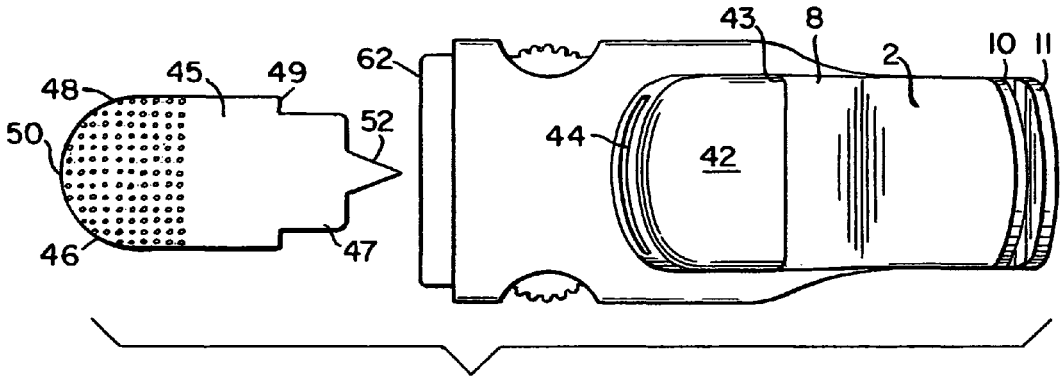
FIG. 2 illustrates a perspective view of a the bi-tool component of the tool holder, according to one embodiment of the disclosure.
Figure 3:
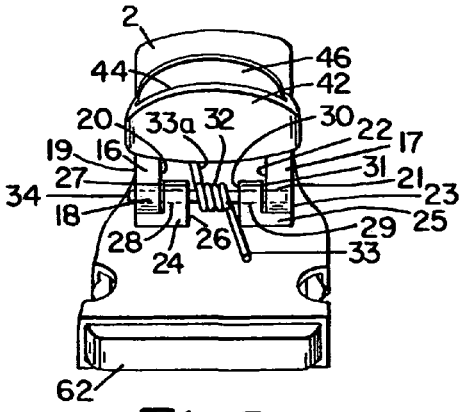
FIG. 3 illustrates a perspective view of the proximal end of the tool holder.
Figure 4:
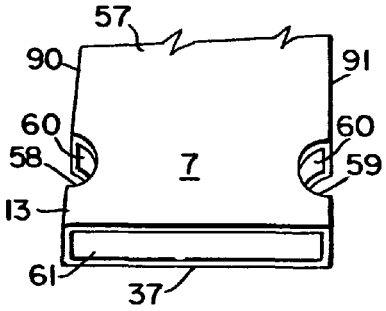
FIG. 4 illustrates the proximal end of the second gripping member of the proximal end of the tool holder.
Figure 5:
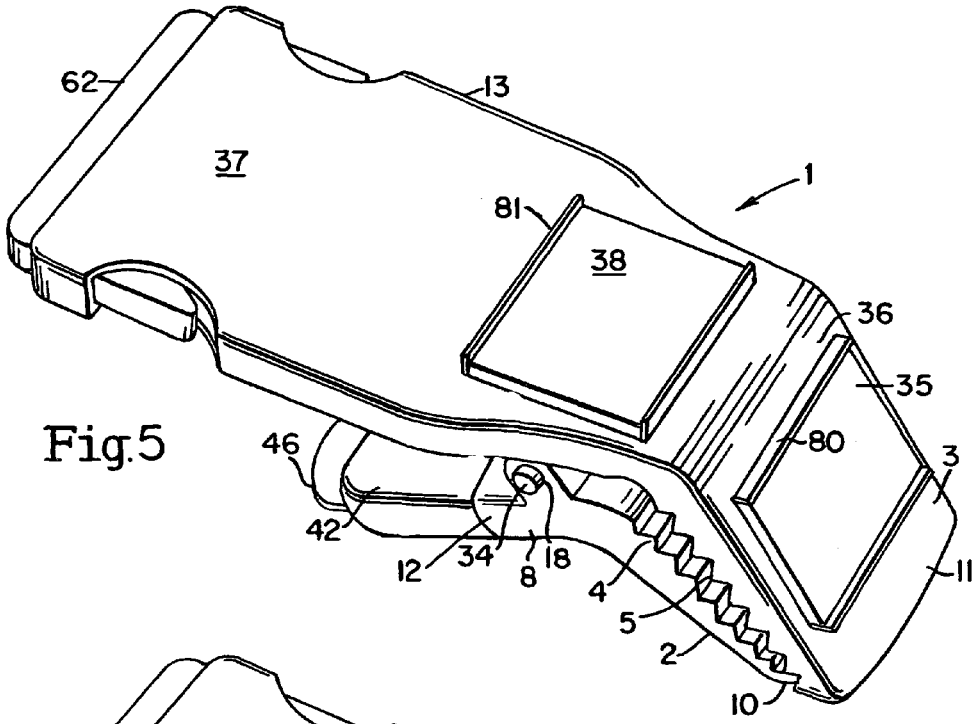
FIG. 5 illustrates a top perspective of the second gripping member of the utility clip.
Figure 8:
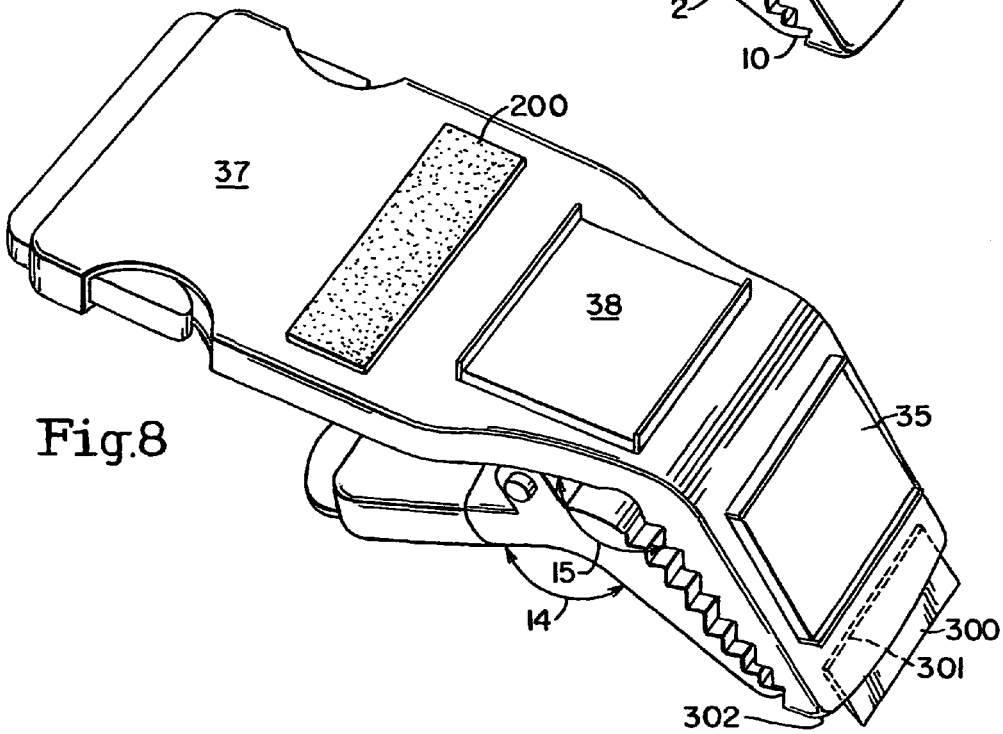
FIG. 8 illustrates the outer side of the second gripping member and another embodiment of the utility clip.
Figure 6:
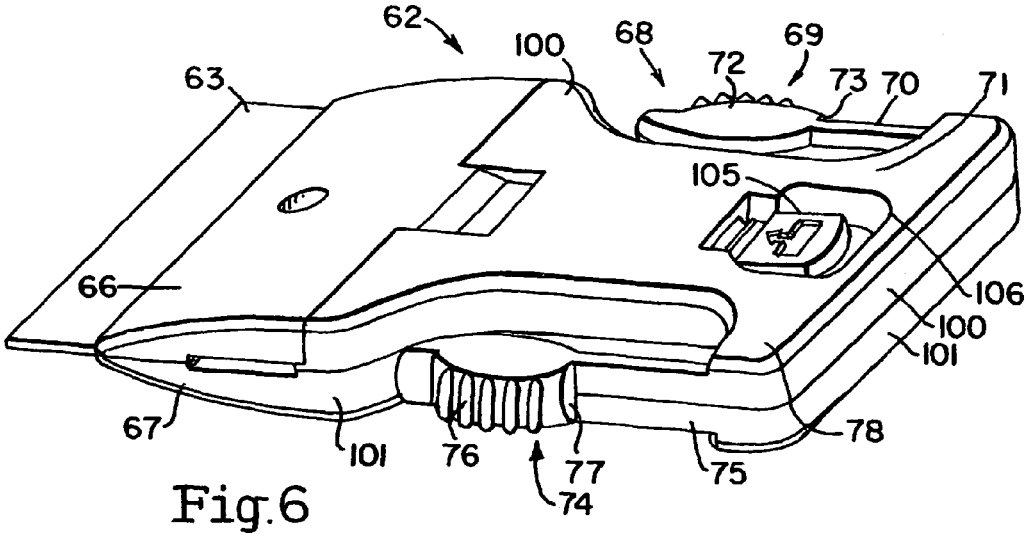
FIG. 6 illustrates a top side perspective view of the tool insert, according to one embodiment of the disclosure.
Figure 7:
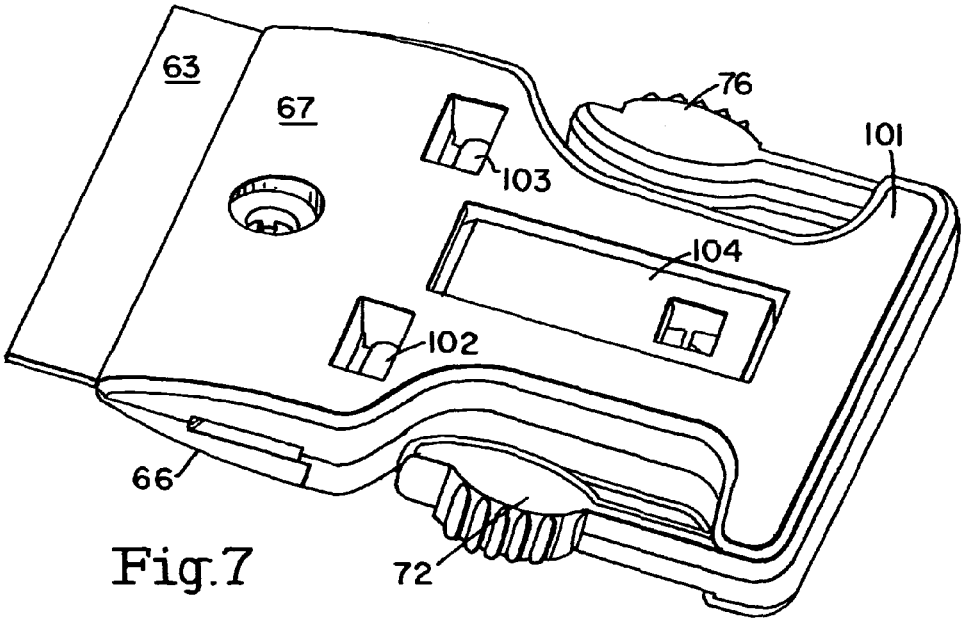
FIG. 7 illustrates a perspective view of a bottom of the tool insert.
Figure 9:
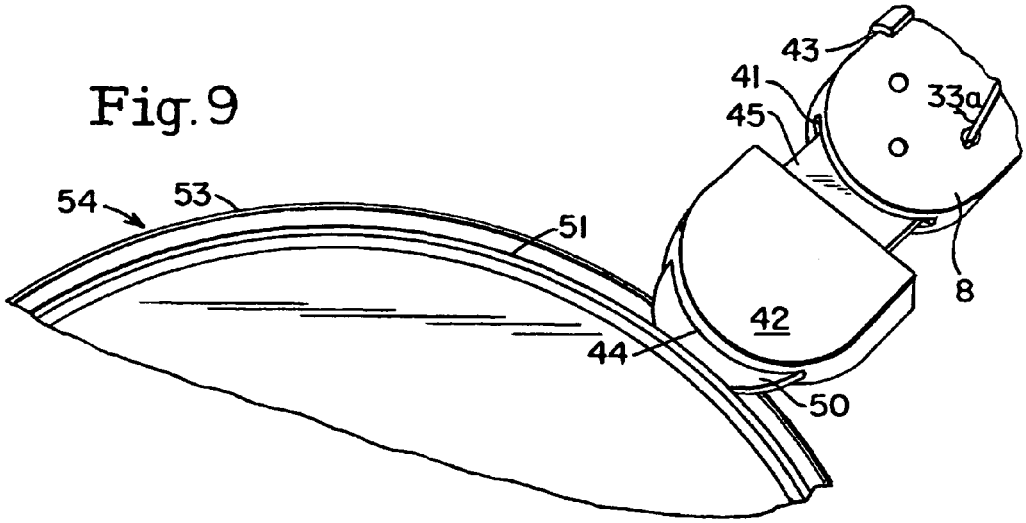
FIG. 9 illustrates a perspective view for the use of the lip for removing the paint can lid.
Figure 10:
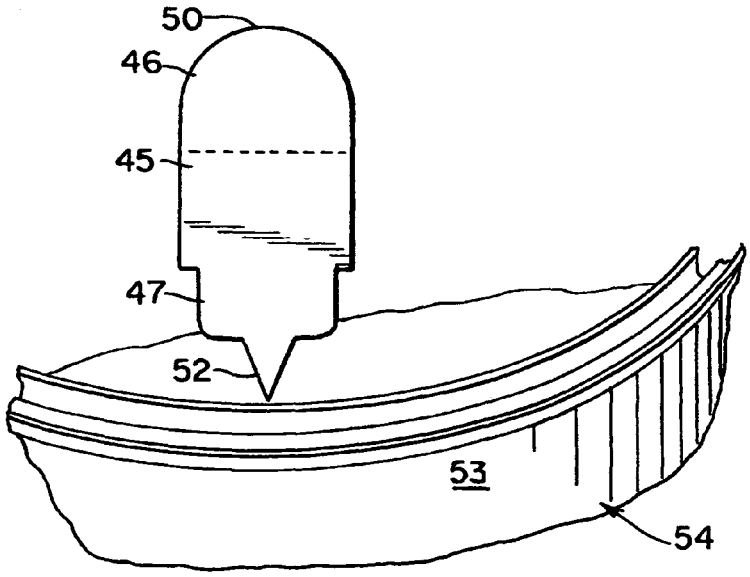
FIG. 10 illustrates a perspective view for the use of the puncture tool.
Figure 11:
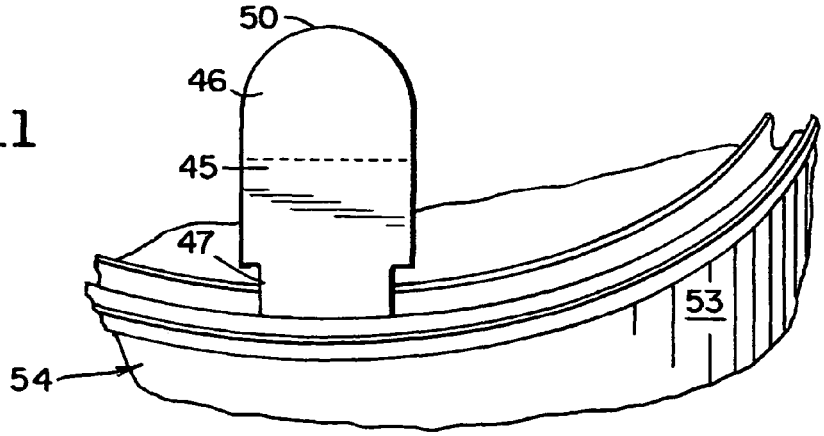
FIG. 11 illustrates another perspective view for the use of the puncture tool.

Referring to FIGS. 1-9, the utility clip 1 comprises a clamping mechanism. The clamping mechanism comprises a first clamping member 2 and a second clamping member 3. The clamping members are preferably made out of plastic, although in an alternative embodiment, the clamping members can be made out of metal. Each of the clamping members 2,3 comprises a set of alligator teeth 4, 5, on the inner side 6, 7 of the distal ends 10, 11 of the clamping members 2, 3. The alligator teeth 4 positioned on an inner side 7 of the distal end 11 of the second clamping member 3 wherein the alligator teeth 4 and alligator teeth 5 are facing each other and are positioned to contact each other at at least one tangent point. In another embodiment, it is possible for the teeth to come close to but not touch each other. The utility clip may range is size from about three inches to about seven inches, although the device can be made in about any size.

A handle 8 is positioned at the proximal end 12 of the first clamping member 2, and a handle 9 is positioned at the proximal 13 end of the second clamping member 3.

The distal end 10 of the first clamping member 2 forms an obtuse angle 14 with the proximal end 12 of the first clamping member 2 and the distal end 11 of the second clamping member 3 forms an obtuse angle 15 with the proximal end 13 of the second clamping member. 3. In one embodiment, the obtuse angle 15 of the second clamping member 3 is greater than the obtuse angle 14 of the first clamping member 2. In another embodiment, the obtuse angle 15 of the second clamping member 3 and the obtuse angle 14 of said first clamping member 2 are equal in degree measurement. Another embodiment allows for the angle 14 of the first clamping member 2 being acute. The obtuse angle of the second clamping member 3 is roughly 135 degrees, although this may vary, and the obtuse angle of the first clamping member is roughly 110 degrees, although this, too, may vary. The proximal end of the second clamping member 3 is about 3½ inches, and the distal end is about 1½ inches, although is may vary by a few inches. The proximal end of the first clamping member 2 is about 2 inches and the distal end is about 1¼ inches long. Of course, this is in relation to the above measurements of the second clamping member, and there can be variations as well, by a few inches.

The first clamping member 2 and the second clamping member 3 are held together by a spring 90. More specifically, a spring 90 is positioned between and connected to the first clamping member 2 and the second clamping member 3, wherein the first clamping member and the second clamping member are angularly and pivotably connected to each other at a pivot point 16.

In one embodiment, a first parallel extension piece 16 and a second parallel extension piece 17 extend from the inner side 6 of the first clamping member 2 and parallel each other. The first parallel extension piece 16 extending from the first clamping member 2 has a hole 18 positioned through an outer wall 19 and an inner wall 20 of the first parallel extension piece 16. The second parallel extension piece 17 has a hole 21 only through the inner wall 22, although in some designs it is possible to have a hole 21 continue through the outer wall 23.

A third parallel extension piece 24 and a fourth parallel extension piece 25 parallel to each other extend from the inner side 7 of the second clamping member 3. The third parallel extension piece 24 has a hole 28 positioned through an inner wall 26 and said outer wall 27 of said third parallel extension piece 24. The fourth parallel extension piece 25 has a hole 29 drilled though the inner wall 30 and said outer wall 31. The third parallel extension piece 24 is positioned next to the inner wall 20 of said first parallel extension piece 16, and said fourth parallel extension piece 25 is positioned next to the inner wall 22 of said second parallel extension piece 17.

The body of coil spring 32 is positioned lengthwise between the third and fourth extension pieces 24 and 25. One leg 33 of the coil spring 32 is in lengthwise contact with an inner side 6, 7, of the first or second clamping members 2, 3, and a second leg 33 is in contact with an inner wall of the second clamping member. A rail pin 34, tight enough to be secured in the holes in the extension pieces 16, 17, 24, 28 and through the center of the coil spring 32. Thus, the first clamping member 2 and the second clamping member 3 are secured together and a releasably biased, such that the alligator teeth at the distal end 6 of the first clamping member 2 and the alligator teeth of the distal end 12 of the second clamping member 3 such that, as mentioned supra, they touch at at least tangentially touch, preferably at the most distal end. By squeezing the proximal ends of the first clamping member 2 and the second clamping member 3, the distal ends (jaws of the utility clip) are reversibly opened.

At least one magnet 35 is positioned on the outer side 36 of the distal end 11 of the second clamping member 3 or at least one magnet 38 is positioned on the outer side 37 of the proximal 13 end of the second clamping member 3. In a another embodiment, at least one magnet 35 is positioned on the outer side 36 of the distal end 13 of the clamping member 3, and at least one magnet 38 is positioned on the outer side 37 of the proximal end 12 of the second clamping member. In another embodiment, these magnets can slid up or down in tracks on the outer side 37 of the proximal end of the second clamping member 3. In another embodiment, the magnet 35 is positioned on the outer side 36 of the distal end 11 of the second clamping member 3, and the outer side 37 of the proximal end of the second clamping member 3. The magnets may be attached directly to the utility clip by means of glue. In an alternative embodiment, each of the magnets 35, 38 reside in a metal seat 80, 81 which are embedded into the outer side 36, 37 of the second clamping member 3. These metal seats 80, 81 may heat annealed or screwed into the second clamping member 3.

In another embodiment, a belt clip is positioned on the back of the second clamping member 3 in place of the magnets. This allows for the utility clip to be attached to a pant loop.

The edge 40 of the proximal end 12 of the first clamping member 2 comprises a pocket opening 41 of the first handle 8. In one embodiment, a rubber handle 42 is positioned over the edge 40 at the proximate end 40 of the first clamping member 3. In that case, the latter part 43 of the proximal end 12 of the first clamping member 2 is indented, so as to allow the rubber handle 42 to fit snuggly over the end of the proximal handle The rubber handle 42 itself has an opening 44, wherein a tool fits within said pocket opening of said rubber handle, and slides into the pocket opening of the first clamping member 41.

The tool that fits within the pocket opening may be a bi-tool 45, which has a tool 46, 47 on each of its ends 48, 49. The bi-tool 45 may be is removably positioned from within the opening 44. The bi-tool 45 may have any number of different tools, with a different tool positioned at each end. In one embodiment, the bi-tool 45 has on one end a lip 50 in which to pry open a paint can lid or some other lid having a similarly shaped lid rim. The lip 50, for removing the paint can lids 51, and is generally a blunt rounded structure, although there may be variations in shapes. In another embodiment, the other end of the tool comprises a puncture tool 52. This tool can be used to puncture the depression between the paint can lid 51 and the side 53 of the paint can 54.

Alternative tools that may be positioned in place of the puncture tool 52 or the lip 50 may include flat and/or phillip head screwdrivers, bottle cap openers, a cork screw or a variety of other tools.

At least one other tool 55 is positioned on the insert-latch lock arrangement 56 at the proximal end 13 of the second clamping member 3 to contain said at least one tool in the second clamping member. Specifically, the latch lock 57 comprises a first open indentation 58 on an outer edge 90 of the proximal end 13 of the second clamping member 3, and a second open indentation 59 on a second outer edge 91 of the proximal end 13 of the second clamping member 3. The first open indentation 58 and the second open indentation 59 are positioned opposite each other on the proximal end 13 of the second clamping member 3, between the inner side 7 and the outer side 37 of the proximal end 13 of the second clamping member 3. A tool receiver space 60 is positioned between the inner side 7 and the outer side 37 of the second clamping member 3, the end of the second clamping member having an tool insert opening 61, thereby forming a pocket for tool insert 62, which fits and reversibly locks into the tool insert opening 61 of the second clamping member 3. The tool insert 62 comprises a tool 63, and a locking handle 68 for holding the tool. The tool 63 may be any number of tools, including but not limited to a razor blade 64, a chisel 65, or some similarly shaped tool. The tools are all designed to fit within the upper jaws 66 and lower jaws 67 of locking handle 68 which holds the tool insert 62. The locking handle 68 also has, along its edge perpendicular to the tool insert, first flexible prong 69 positioned at a first locking handle edge 70 perpendicular to the gripping section 71, and positioned facing outward at the edge of the tool insert 62. The first flexible prong 69 has a first bulbous end 72 with a first blunt flat end 73. Additionally, along the second edge of the tool insert is a second flexible prong 74 positioned at a second locking handle edge 75 perpendicular to the gripping section, and positioned facing outward at the edge of the tool insert 62. The second flexible prong 74 has a second bulbous end 76 with a blunt flat end 77. The first and second prongs 69, 74 are connected by a bridge piece which serves as the removal handle 78 and which extends outward from the proximal end of the second gripping member 3.

In one embodiment, the tool insert positioned between the upper jaw 66 and lower jaw 67 may be interchangeable with other tools. This is made possible by constructing the tool insert such that the upper jaw 66 and the lower jaw 67 can be opened and securely closed. This is achieved by having a top section 100 and bottom section 101 of the tool insert. The bottom section 101 can be integral with the lower jaw 67, or it may be molded as a separate piece. The upper jaw 66 is connected to the top section 100 by means of a hinge 102, 103. Connected, integrally or not with an extension 103 of the top jaw 66 is a pushable button 104, coming through the bottom section 101, which, when pushed, allows for the top 105 of the button 104 to push through an opening 106 where is snaps closed on a snap lip, and thus the upper jaw 66 is closed securely into place. The upper jaw 66 is opened by pressing the top 105 of the button 104.

Other tools may be incorporated into the tool insert. A shave hook or paint scraper 452 may also be incorporated in place of the razor blade. Alternatively, the tool may be a flat screwdriver 400 or a Phillips head screwdriver 401 all having a broad flat handle 402 for gripping by the upper and lower jaws 66, 67.

Additionally, the utility clip 3 may further comprise a small sharpening stone 200 positioned proximal to the magnet 38 on the outer side 37 of the proximate end 13 of the second clamping member 3.

In addition, a paint scraper 300 may be embedded within the plastic, or in a pocket 301 of the plastic at the distal end 11 of the second clamping member 3, at the edge 302 in front of the alligator teeth 5. Alternatively, the paint scraper attachment 300 may be secured by screws or by glue to the outer side 36 of the distal end 11 of the second clamping member 3.

There are numerous ways in which this tool may be used. If, for example, a painter is using this tool, he could clip the utility clip to the side of an open paint can, and attach the brush to magnet on the outer side of the second clamping member. In another embodiment, if the can being used is iron based, the clip can be attached to the can via the magnets, and the alligator teeth can be used to hold the brush. The tools included in the utility clip include the lip, which can be used to open up the can, the puncture tool, so that excess paint can be drained back into the can, and the razor blade can be used to trim excess paint on windows left over from when window frames are painted. Other tools that may be incorporated such as straight or Phillips head screwdrivers can be used to remove light switch plates. The screw drivers may be positioned at the distal end of the bi-tool.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the disclosure and various changes can be made in the function and arrangements of the aspects of the technology without departing from the spirit and scope of the appended claims.

We claim:

1. A utility clip, said utility clip comprising:

a) first clamping member, said first clamping member comprising:
  i) a first set of alligator teeth on an inner side of a distal end of said first clamping member;
  ii) a first handle positioned at the proximal end of said first clamping member, said first handle comprising:
    A) a pocket opening at an edge at the top of said first handle; and
    B) a bi-tool removably positioned within the pocket opening of the first handle of the first clamping member, said bi-tool comprising two ends, said two ends comprising:
      i) a proximal end of said bi-tool comprising a lip, said lip configured to open a container having a lid with an inner lip; and
      ii) a distal end of said bi-tool comprising a puncture member, configured to puncture materials, wherein said bi-tool is reversible within said pocket opening of the first handle;

b) a second clamping member, said second clamping member comprising:
  i) a second set of alligator teeth positioned on an inner side of distal end of the second clamping member wherein said second set of alligator teeth are positioned to contact said first set of alligator teeth at least one tangent point;
  ii) a second handle positioned at the proximal end of the said second clamping member, said second handle comprising:
    A) a second handle opening at an edge at the top of said second handle;
    B) a tool insert-latch lock arrangement at the proximal end of said second clamping member to contain at least one tool of said second clamping member, said latch lock comprising:

i) a first open indentation on an outer edge of said Proximal end H of said second clamping member;

ii) a second open indentation on an inner edge of said proximal end of said second clamping member, said first indentation and said second indentation positioned opposite each other on said proximal end of said second clamping member; said inner side of said proximal end of said second clamping member and said outer side of said proximate end of said second clamping member aligned and opposite each other;

C) a tool receiver space positioned between said inner side of said second clamping member and said outer side of said second/clamp member, said end of said second clamping member being open;

D) a tool insert fitting and reversibly locking into said space of said second clamping member, said tool insert comprising:

i) a tool;

ii) a locking handle for holding said tool insert, said handle comprising:

AA) a gripping section;

BB) a first flexible prong positioned at a first locking handle edge perpendicular to the gripping section, said first flexible prong having a first bulbous end with a first blunt flat end; and edge perpendicular to the gripping section, second flexible prong having a second bulbous end with a second blunt flat end said first locking edge handle edge and said second handle locking edge being on opposite and parallel edges of said locking handle;

CC) a grip for supporting said tool insert, said grip being at the distal end of said tool insert, said grip comprising:

1A) an upper lip and 2B) a lower lip; said tool being positioned firmly between said upper lip and lower lip, said upper lip and said lower lip being positioned at the distal end of the grip; wherein said tool insert is inserted into said tool receiver space, and said first bulbous end and said second bulbous end are positioned into said first open indentation and said second open indention, respectively, reversibly locking said tool insert into said opening of said second clamping member;

c) at least one magnet positioned on an outer side of said second clamping member; and d) a spring positioned between and connected to said first clamping member and said second clamping member, wherein said first clamping member and said second clamping member are angularly connected and pivotably connected to each other.

2. The utility clip of claim 1, further comprising:

a) a first parallel extension piece and a second parallel extension piece parallel to each other extending from the inner side of the first clamping member, i) said first parallel extension piece having a hole positioned through an inner wall and outer wall of said first parallel extension piece; and ii) said second parallel extension piece having a hole drilled though the inner wall of said second parallel extension piece;

b) a third parallel extension piece and a fourth parallel extension piece parallel to each other extending from the inner side of the second clamping member, i) said third parallel extension piece having a hole positioned through an inner wall and said outer wall of said third parallel extension piece; and ii) said fourth parallel extension piece having a hole drilled though the inner wall and said outer wall of said fourth parallel extension piece; said third parallel extension piece being positioned next to the inner wall of said first parallel extension piece, and said fourth parallel extension piece being position next to the inner wall of said second parallel extension piece;

c) a rail pin;

d) a coil spring, said coil spring comprising:

i) a coiled body;

ii) a first leg at the beginning of said coil;

iii) a second leg at the end of said coil; said first leg of said coil being in lengthwise contact with an inner side of said first clamping member, said second leg of said coil being in lengthwise contact with an inner side of said second clamping member, and wherein said rail pin sequentially passes through said first parallel extension piece, said third parallel extension piece, said coil spring, said fourth parallel extension piece, and goes through the opening of said inner wall of said second parallel extension piece.

3. The utility clip of claim 1, wherein: said distal end of said first clamping member forms an obtuse angle with the proximal end of said first clamping member; and said distal end of said second clamping member forms an obtuse angle with the proximal end of said second clamping member.

4. The utility clip of claim 3, wherein said obtuse angle of said obtuse angle of said second clamping member is greater than the obtuse angle of said first clamping member.

5. The utility clip of clamp 3, wherein said obtuse angle of said second clamping member and said obtuse angle of said first clamping member are equal in degree measurement.

6. The utility clip of claim 1, further comprising a rubber handle positioned at the proximate end of said first clamping member wherein said pocket opening for said bi-tool fits within said pocket opening of said rubber handle.

7. The utility clip of claim 1, wherein said at least one magnet is on the outer side of the distal end of the second clamping member.

8. The utility clip of claim 1, wherein said at least one magnet is on the outer side of the proximal end of the second clamping member.

9. The utility clip of claim 1, wherein said at least one magnet is on the outer side of the proximal end of the second clamping and wherein at least one magnet is one the outer side of the distal end of the second clamping member.

10. The utility clip of claim 1, wherein said tool insert is selected from the group consisting of a razor blade, a chisel, and a paint scraper.

11. The utility clip of claim 1, further comprising a sharpening stone positioned proximal to the magnet on the outer side of the proximate end of the second clamping member.

12. The utility clip of claim 1, further comprising a paint scraper positioned at the edge of the distal end of the second clamping member.

* * * * *